US012458133B2

(12) United States Patent
Whiting et al.

(10) Patent No.: US 12,458,133 B2
(45) Date of Patent: Nov. 4, 2025

(54) TUBULAR BAND WITH SEAMLESS LUG INTEGRATION

(71) Applicant: Google LLC, Mountain View, CA (US)

(72) Inventors: Eric Whiting, San Francisco, CA (US); Idil Girard, Sunnyvale, CA (US); Ferdinand Aichriedler, San Francisco, CA (US); Melissa Autumn Bree, Oakland, CA (US); BreAnna Nicole Conner, Mountain View, CA (US); Mark Anthony Zarich, Oakland, CA (US); Milan Jaykrushna Bhatt, Richmond, CA (US); Justin Lane Williams, San Francisco, CA (US)

(73) Assignee: Google LLC, Mountain View, CA (US)

( * ) Notice: Subject to any disclaimer, the term of this patent is extended or adjusted under 35 U.S.C. 154(b) by 140 days.

(21) Appl. No.: 18/505,932

(22) Filed: Nov. 9, 2023

(65) Prior Publication Data

US 2024/0065424 A1 Feb. 29, 2024

Related U.S. Application Data

(60) Provisional application No. 63/596,895, filed on Nov. 7, 2023.

(51) Int. Cl.
*A44C 5/14* (2006.01)
*A45F 5/00* (2006.01)

(52) U.S. Cl.
CPC ..... *A45F 5/00* (2013.01); *A45F 2005/008* (2013.01)

(58) Field of Classification Search
CPC ..... A45F 2005/008; G04B 37/16; G04B 37/1486; A44C 5/0053; A44C 5/14; A44C 5/147; A44C 5/0069; Y10T 24/4782
(Continued)

(56) References Cited

U.S. PATENT DOCUMENTS 1,736,166 A * 11/1929 Nittel ..... A44C 5/0061 63/5.1
2,270,216 A * 1/1942 Marwil ..... A44C 5/0069 224/175

(Continued)

FOREIGN PATENT DOCUMENTS

CN 115556431 1/2023

OTHER PUBLICATIONS

"MoKo Watch Lugs", Retrieved at: https://www.ubuy.co.in/product/1PKEQOH2G-moko-watch-lugsconnectorsclasps-compatible-with-apple-watch-42mm-44mm-series-654321se-watch-band-replaceable-metal-connection-adapternot-fit-38mm—on Aug. 9, 2023, 6 pages.

*Primary Examiner* — Jack W Lavinder
(74) *Attorney, Agent, or Firm* — Colby Nipper PLLC

(57) ABSTRACT

This document describes techniques and apparatuses directed at providing a tubular band with seamless lug integration for wearable devices. In aspects, the tubular band includes an extensible strap formed of interwoven fibers. The strap includes opposing outward-facing edges at opposing longitudinal ends. Each edge defines an opening within which a base section of a coupling device can reside. The coupling device further includes an attachment section, opposite the base section, which extends from the base section outwardly through the opening to engage a coupling connector of the wearable device. When the attachment section is connected to the coupling connector, the attachment section positions an end portion of the strap adjacent the opening to engage a surface of the wearable device. In this way, the strap can be coupled to a wearable device by positioning end portions of the strap against one or more surfaces of the wearable device, forming a seamless connection between the band and the wearable device.

20 Claims, 6 Drawing Sheets

(58) Field of Classification Search
USPC ..... 63/5.1; 224/164, 180
See application file for complete search history.

(56) References Cited

U.S. PATENT DOCUMENTS

| | | | | | |
|---|---|---|---|---|---|
| 2,427,119 | A | * | 9/1947 | Bensel | A41F 9/002 2/338 |
| 2,558,007 | A | * | 6/1951 | Smith | A44C 5/0069 267/74 |
| 3,063,058 | A | * | 11/1962 | Vollet | A44C 5/0069 224/175 |
| 4,605,312 | A | * | 8/1986 | Sellier | G04B 37/1486 368/282 |
| 5,927,296 | A | * | 7/1999 | Maturaporn | A45D 8/36 132/273 |
| 10,058,149 | B1 | | 8/2018 | Wittenberg et al. | |
| 2023/0004129 | A1 | | 1/2023 | Ershov et al. | |
| 2023/0119270 | A1 | | 4/2023 | Cazalet et al. | |

* cited by examiner

TUBULAR BAND WITH SEAMLESS LUG INTEGRATION

CROSS-REFERENCE TO RELATED APPLICATION(S)

This application claims priority to U.S. Provisional Patent Application Ser. No. 63/596,895 filed on Nov. 7, 2023, the disclosure of which is incorporated by reference herein in its entirety.

SUMMARY

This document describes techniques and apparatuses directed at providing a tubular band with seamless lug integration for wearable devices. In aspects, the tubular band includes an extensible strap formed of interwoven fibers. The strap includes opposing outward-facing edges at opposing longitudinal ends. Each edge defines an opening within which a base section of a coupling device can reside. The coupling device further includes an attachment section, opposite the base section, which extends from the base section outwardly through the opening to engage a coupling connector of the wearable device. When the attachment section is connected to the coupling connector, the attachment section positions an end portion of the strap adjacent the opening to engage a surface of the wearable device. In this way, the strap can be coupled to a wearable device by positioning end portions of the strap against one or more surfaces of the wearable device, forming a seamless connection between the band and the wearable device.

This Summary is provided to introduce techniques and apparatuses directed at providing a tubular band with seamless lug integration for wearable devices. In implementations, a band includes a strap and attachment devices to couple the strap to a wearable device. End portions of the strap are positioned against a surface of the wearable device, forming a seamless connection between the band and the wearable device, as further described below in the Detailed Description and Drawings. This Summary is not intended to identify essential features of the claimed subject matter, nor is it intended for use in determining the scope of the claimed subject matter.

BRIEF DESCRIPTION OF THE DRAWINGS

The details of one or more aspects of techniques and apparatuses directed at providing a tubular band with seamless lug integration for wearable devices are described in this document with reference to the following drawings. The same numbers are used throughout the drawings to reference like features and components.

DETAILED DESCRIPTION

Overview

Wearable devices, including smartwatches and computing goggles, are increasing in popularity. These wearable devices often include plastic, rubber, and/or fabric components (e.g., bands) to enable these devices to be worn at different locations of the body. For example, smartwatches are often provided with plastic or rubberized straps that buckle around a user's wrist on a side opposite a smartwatch interface. In some cases, bands of wearable devices may additionally, or alternatively, include leather or metallic components. However, these leather and/or metallic components (e.g., bands) may not be optimal in some contexts or for some users. For example, perspiration caused by physical exercise may damage leather components, while metallic components may chafe or pinch a user's skin.

To this end, this document describes techniques and apparatuses directed at providing a tubular band with seamless lug integration for wearable devices. In aspects, the tubular band includes an extensible strap formed of interwoven fibers. The strap includes opposing outward-facing edges at opposing longitudinal ends. Each edge defines an opening within which a base section of a coupling device can reside. The coupling device further includes an attachment section, opposite the base section, which extends from the base section outwardly through the opening to engage a coupling connector of the wearable device. When the attachment section is connected to the coupling connector, the attachment section positions an end portion of the strap adjacent the opening to engage a surface of the wearable device. In this way, the strap can be coupled to a wearable device by positioning end portions of the strap against one or more surfaces of the wearable device, forming a seamless connection between the band and the wearable device.

Example Band

Figure 1:
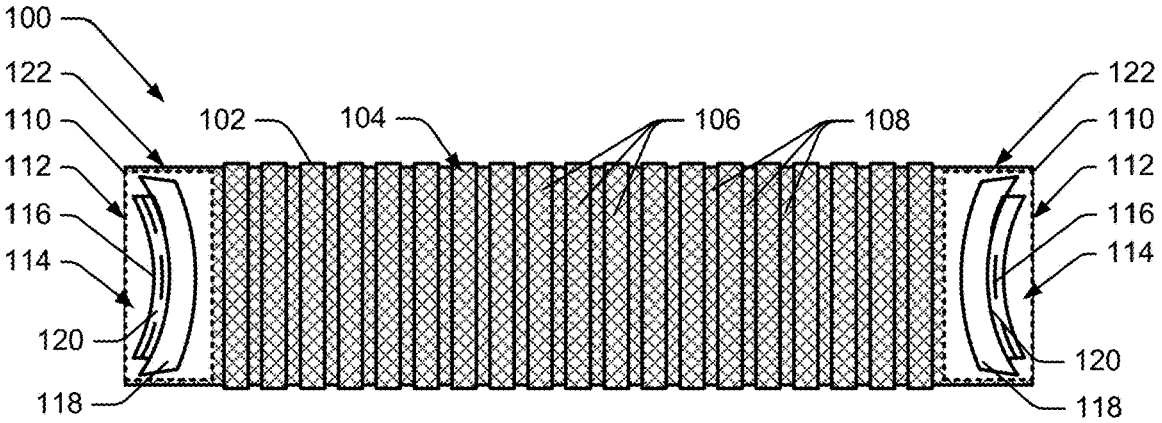
FIG. 1 illustrates a two-dimensional view in partial cross-section of an example band for attaching a wearable device in accordance with one or more implementations.

FIG. 1 illustrates a two-dimensional view in partial cross-section of a band 100 for attaching a wearable device (not shown in FIG. 1) in accordance with one or more implementations. In implementations, the band 100 includes a strap 102 formed of an extensible, tubular structure formed of interwoven fibers 104. For example, the interwoven fibers 104 of the strap 102 may be knit together (as represented by the crosshatched fill pattern of the strap 102 in FIG. 1) or loomed or formed by another method. The knitting or other joining of the interwoven fibers 104 provide an extensible structure that allows the strap 102 to stretch and compress to fit a user's arm, leg, head, or chest, as further described below. The strap 102 also may incorporate one or more lateral ribs 106, interspersed with non-ribbed spaces 108, to facilitate stretching and compressing of the strap 102, a construction used in socks, sweaters, and other knit garments designed to deformably fit a wearer's body.

The strap 102 also includes edges 110 at opposing, longitudinal ends 112 of the strap 102. As further described below, each of the edges 110 defines an opening 114 within the strap 102 (outlined in dotted lines in FIG. 1). Each of the openings 114 receives a coupling device 116. Each of the coupling devices 116 includes a base section 118 that is fully receivable within one of the openings 114 defined by the edges 110 of the strap 102. Each of the coupling devices 116 also includes an attachment section 120 that is configured to extend outwardly from the base section 118 through the opening 114 to engage a coupling connector of the wearable device (not shown in FIG. 1). The extension of the attachment section 120 from within the opening 114 enables the strap 102 to couple with the wearable device while positioning an end portion 122 of the strap 102 adjacent the opening 114 to engage a surface of the wearable device, as further described below with reference to FIGS. 4A and 4B.

Figure 2:
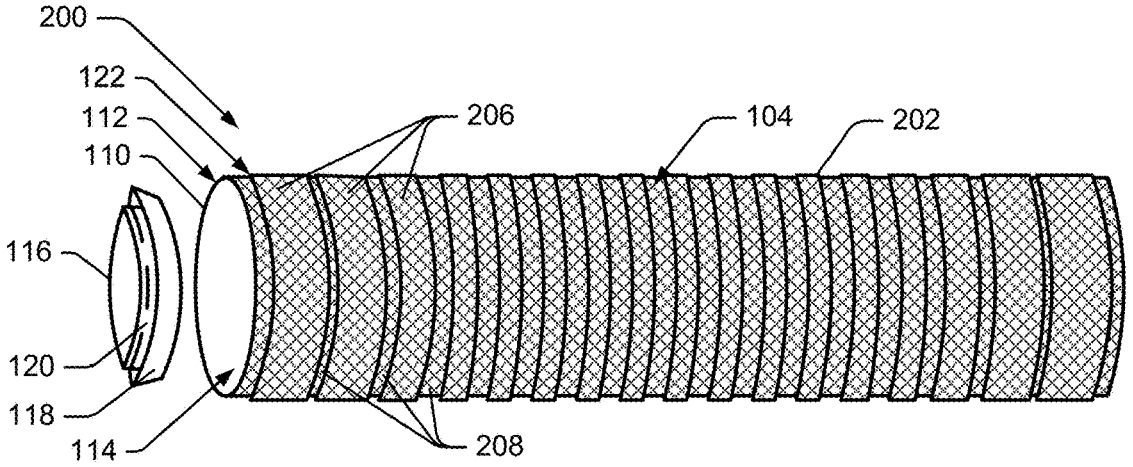
FIG. 2 illustrates an exploded perspective diagram of an example band.

FIG. 2 illustrates an exploded perspective diagram of a band 200 (e.g., band 100). As illustrated, the exploded perspective diagram depicts the coupling device 116 before it is inserted within the opening 114. In implementations, a strap 202 has a tubular structure, as might be produced by knitting or other looming from a round loom or circular needles (not shown). The strap 202 includes differently-sized lateral ribs 206 interspersed by differently-shaped non-ribbed spaces 208, in contrast to the uniformly-sized ribs 106 and non-ribbed spaces 108 of the strap 102 (see FIG. 1). Implementations of the straps 102 and 202, if lateral ribs 106 and/or 206 are used, are not limited to any particular type of ribbing or spacing configuration.

Figure 3A:
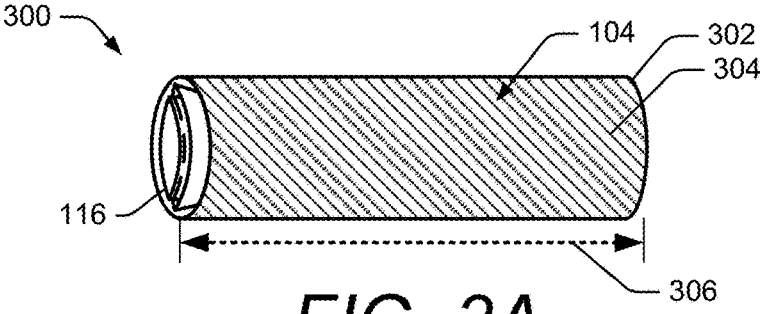
FIGS. 3A and 3B illustrate perspective diagrams of an example band in unstretched and stretched configurations, respectively.
Figure 3B:
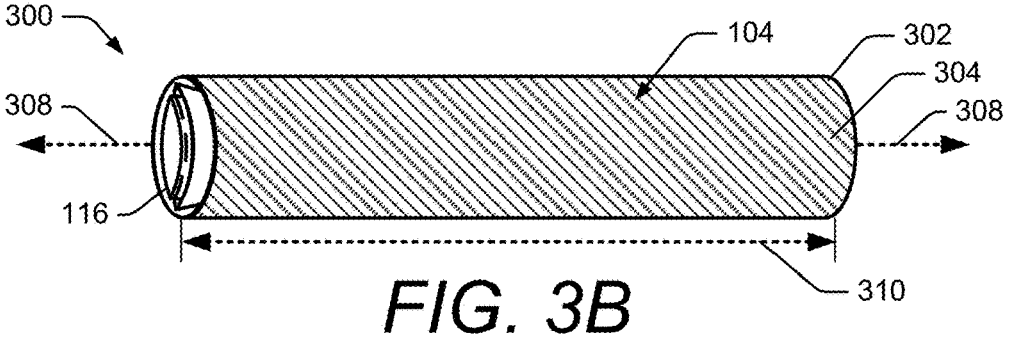

Referring to FIGS. 3A and 3B, in implementations, a band 300 includes a strap 302 incorporating an extensible tube 304 of the interwoven fibers 104. As described with reference to FIGS. 1 and 2, the interwoven fibers 104 may be formed into the straps 102 and 202 by knitting (as represented in FIGS. 1 and 2 by the crosshatched pattern of the straps 102 and 202). Alternatively, the strap 302 may be formed by braiding together the interwoven fibers 104 (as represented by the angled fill pattern of the band 300 in FIGS. 3A and 3B). Regardless of the process used, the extensible tube 304 is stretchable to fit over a portion associated with a user (e.g., an extremity, clothing) or to flex with a user's movement and contractable to conform to the portion of the user to remain in place. As shown in FIG. 3A, with no longitudinal forces applied, the extensible tube 304 may remain in an unstretched position 306. As shown in FIG. 3B, however, when a longitudinal force 308 is applied to the extensible tube 304, the extensible tube 304 extends to a stretched position 310. With the longitudinal force 308 removed, the strap 302 incorporating the extensible tube 304 compresses toward the unstretched position 306 of FIG. 3A.

Figure 4A:
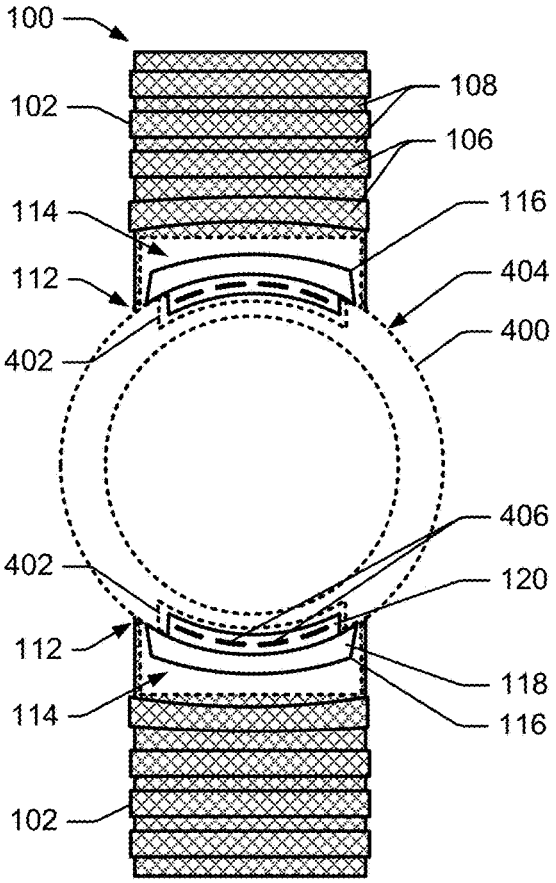
FIG. 4A illustrates a partial cutaway view of an example band attached to a smartwatch.
Figure 4B:
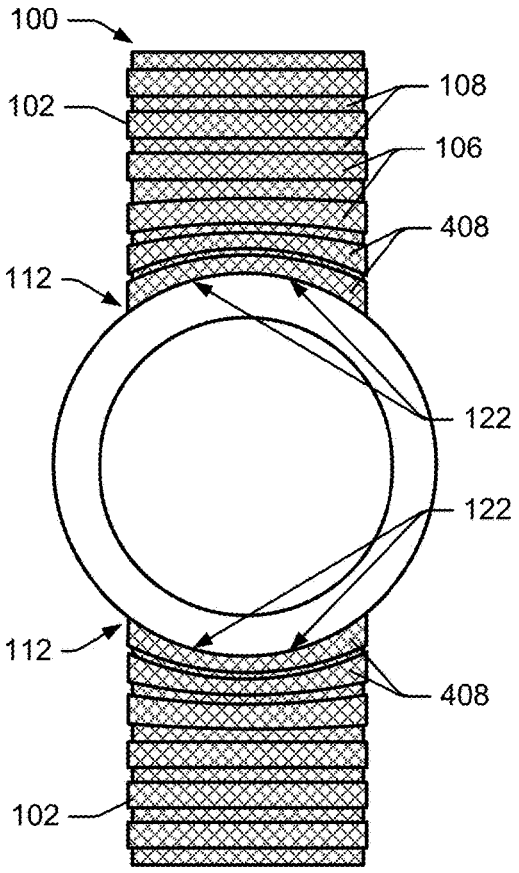
FIG. 4B illustrates a top view of an example band attached to a smartwatch.

FIGS. 4A and 4B show the band 100 of FIG. 1 coupled with a smartwatch 400 equipped with the band 100 of FIG. 1. Referring to FIG. 4A, a partial cutaway view of the band 100 illustrates the attachment sections 120 of the coupling devices 116 extending from the openings 114 at the longitudinal ends 112 of the strap 102, with the base sections 118 adhesively or otherwise joined with the strap 102. The attachment sections 120 are mechanically joined to or otherwise engaged with coupling connectors 402 (shown in dotted lines in FIG. 4A) of the smartwatch 400. In implementations, the coupling connectors 402 of the smartwatch 400 are recessed within a surface 404 of the smartwatch 400 or extend from the surface 404 of the smartwatch 400 where the coupling devices 116 are received by the coupling connectors 402. For example, the attachment sections 120 of the coupling devices 116 may engage the coupling connectors 402 with interlocking tabs and notches 406, securing the band 100 to the smartwatch 400 and positioning the end portions (not shown in the partial cutaway view of the band 100 of FIG. 4A) of the band 100 against the surface 404 of the smartwatch 400.

Referring to FIG. 4B, with the coupling devices 116 housed within the openings 114 of the longitudinal ends 112 of the strap 102, neither the coupling devices 116 nor the coupling connectors 402 block or prevent the end portions 122 of the strap 102 from abutting directly with the surface 404 of the smartwatch 400. The end portions 122 of the strap 102 abut the surface 404 of the smartwatch 400, without leaving a gap or seam between the band 100 and the smartwatch 400. The interwoven fibers 104 flex to conform the longitudinal ends 112 to the surface 404 of the smartwatch 400, as illustrated by proximate ribs 408 nearest the longitudinal ends 112 of the strap 102 deforming from a straight position (as shown in FIG. 1) to conform to the surface 404 of the smartwatch 400.

Figure 5:
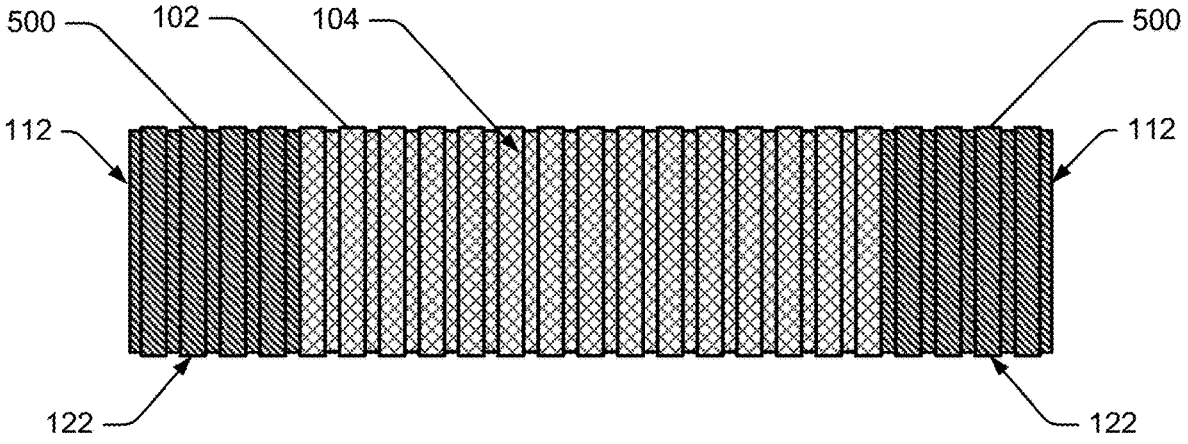
FIG. 5 illustrates a top view of an example strap dipped or impregnated with a flexible material.

Referring to FIG. 5, to strengthen and/or to add color to portions of the strap 102, portions of the strap 102 may be dipped in or impregnated with a flowable, flexible material 500 such as silicone or polyurethane (as represented in FIG. 5 with a dense hatching pattern). For example, to prevent the interwoven fibers 104 at the longitudinal ends 112 of the strap 102 from fraying or becoming non-interwoven, portions 502 of the strap 102 may be dipped in or impregnated with the flexible material 500. Applying the flexible material 500 portions 502 of the strap 102 adjacent to the longitudinal ends 112 may prevent or reduce the interwoven fibers 104 in the end portions 122 from fraying as a result of the end portions 122 rubbing against the surface 404 of the smartwatch 400, as described with reference to FIG. 4B.

Figure 6A:
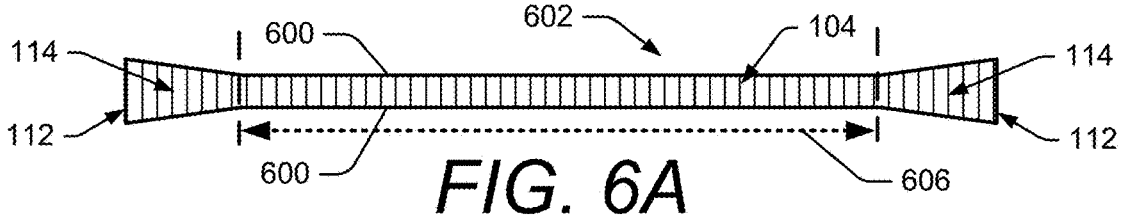
FIGS. 6A-6C illustrate side views of an example band with portions of opposing sides joined together.
Figure 6B:
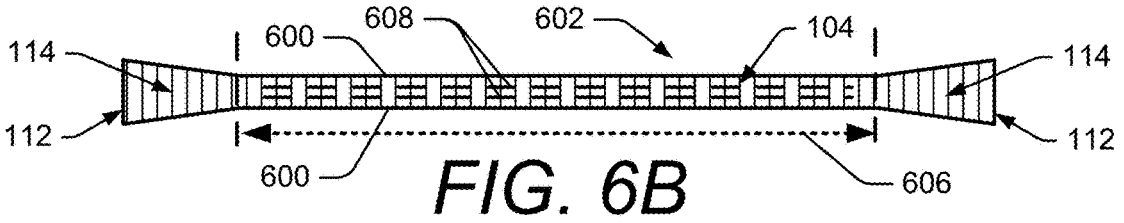
Figure 6C:
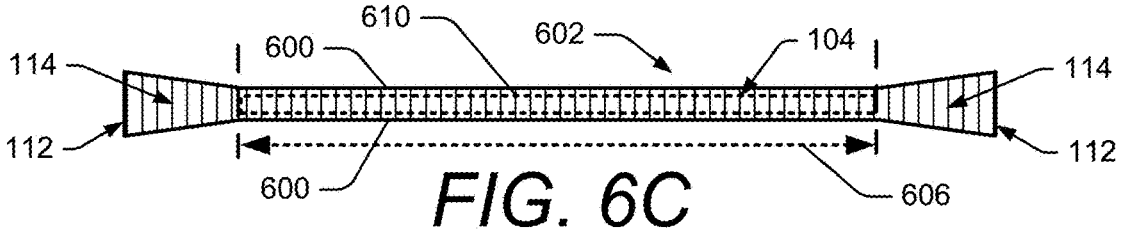

Referring to FIGS. 6A-6C, sides 600 of a strap 602 may be joined to flatten the tube 304 (see FIGS. 3A and 3B) to prevent twisting and/or abrading of the strap 602. Referring to FIG. 6A, a middle section 606 between the openings 114 at the longitudinal ends 112 of the strap 602 may be integrally joined during production of the extensible tube 304 (see FIG. 3) used in producing the strap 602. For example, where the strap 602 is formed by weaving together the interwoven fibers 104 (as represented by the linear fill pattern of the strap 602 in FIGS. 6A-6C), the middle section 606 of the strap 602 may be interwoven to join together the sides 600. Similarly, if a strap is formed by knitting, braiding, or another process, the sides 600 of the strap 602 may be knit, braided, or otherwise integrally joined. Alternatively, referring to FIG. 6B, the sides 600 of the middle section 606 of the strap 602 may be joined together with stitching 608 to hold the sides 600 together. Further alternatively, referring to FIG. 6C, the sides 600 of the middle section 606 of the strap 602 may be joined together with an adhesive 610 (represented by a region outlined in a dotted line in FIG. 6C to represent the internally-disposed adhesive) to hold the sides 600 together.

Figure 7:
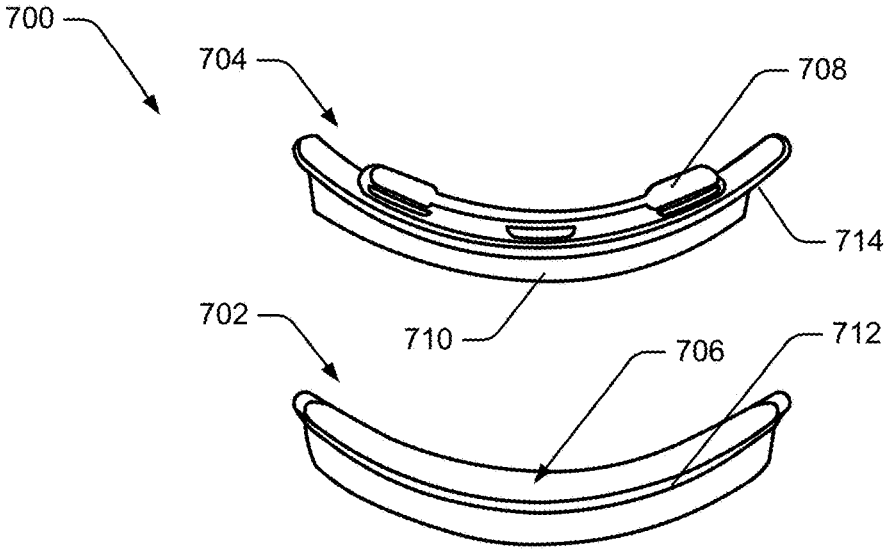
FIG. 7 illustrates an exploded view of a multi-part coupling device for attaching a strap to a wearable device.

The coupling devices 116 (see FIG. 1) may be one-piece devices that are adhesively or otherwise joined to the strap 102. Alternatively, referring to FIG. 7, a coupling device 700 with separate components may be used. The multi-part coupling device 700 may include a base component 702 and an attachment component 704, configured to attach the coupling device 700 to the strap 102 and attach the strap 102 to the smartwatch 400 (see FIG. 4). In implementations, the base component 702 is fully receivable within one of the openings 114 in the strap 102. The base component 702 defines a receiving slot 706 configured to receive the edges 110 of the strap 102.

The attachment component 704 includes an attachment lug 708 configured to engage the coupling connector 402 of the smartwatch 400. The attachment component 704 also includes a base lug 710 configured to be insertable within the receiving slot 706 of the base component. The base lug 710 is also configured to engage and secure the edges 110 of the strap 102 within the receiving slot 706 of the base component 702. As further described with reference to FIGS. 8A-8D, the edges 110 of the strap 102 may be folded or curled inwardly. With the edges 110 of the strap 102 curled inwardly, the base lug 710 engages the edges 110 of the strap 102 and secures the edges 110 of the strap 102 within the receiving slot 706 to position the end portions 122 of the strap 102 to engage the surface 404 of the smartwatch 400. In implementations, the base component 702 may include a base flange 712 and/or the attachment component 704 may include an attachment flange 714 to mechanically engage therebetween the edges 110 of the strap 102 to facilitate securing the edges 110 of the strap 102 between the base component 702 and the attachment component 704.

Figure 8A:
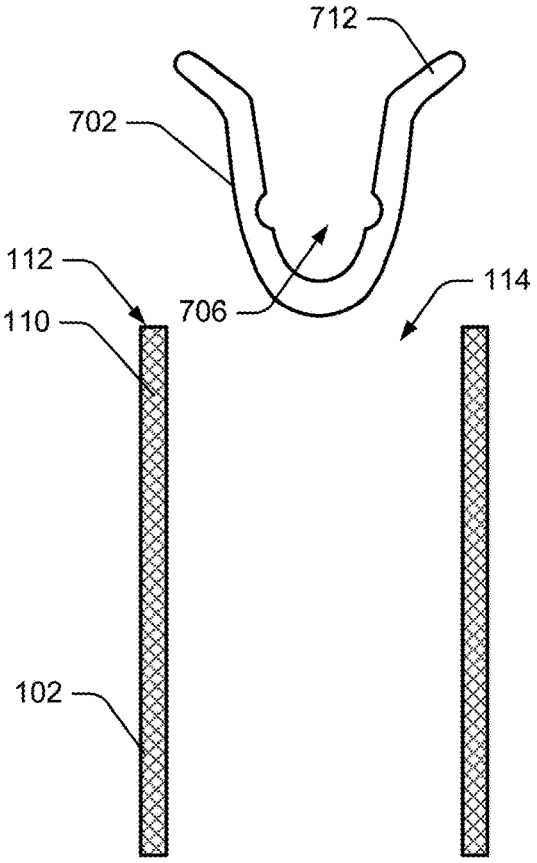
FIGS. 8A-8D illustrate cross-sectional side views of the multi-part coupling device of FIG. 7 being attached to a strap.
Figure 8B:
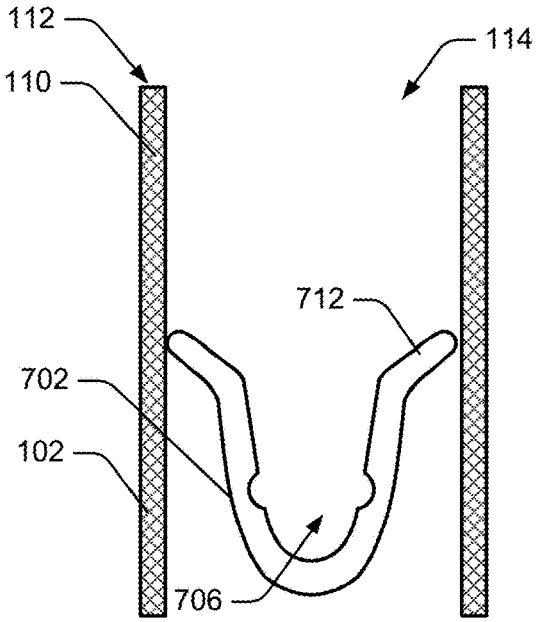
Figure 8C:
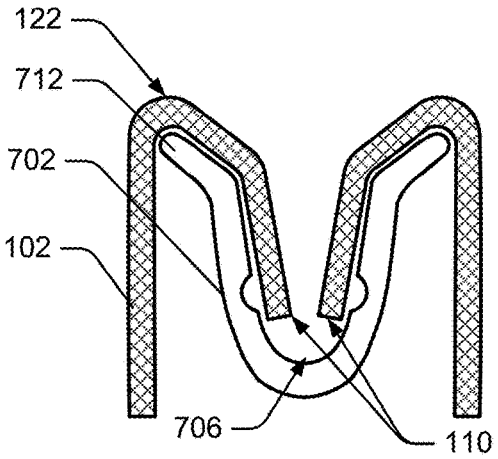

FIGS. 8A-8D depict the securing of the coupling device 700 to the strap 102. FIG. 8A shows the base component 702 positioned between the edges 110 of the strap 102 for insertion within the opening 114 at a longitudinal end 112 of the strap 102. FIG. 8B shows the base component 702 inserted within the opening 114, received entirely beyond the longitudinal end 112 of the strap 102, inside the edges 110 of the strap 102. FIG. 8C shows the edges 110 of the strap 102 folded or curled inwardly into the opening 114 and inside the receiving slot 706 of the base component 702, with the end surfaces 122 of the strap 102 wrapped around the base component 702. When the base component 702 includes the base flange 712, the end surfaces 122 wrap around the base flange 712.

Figure 8D:
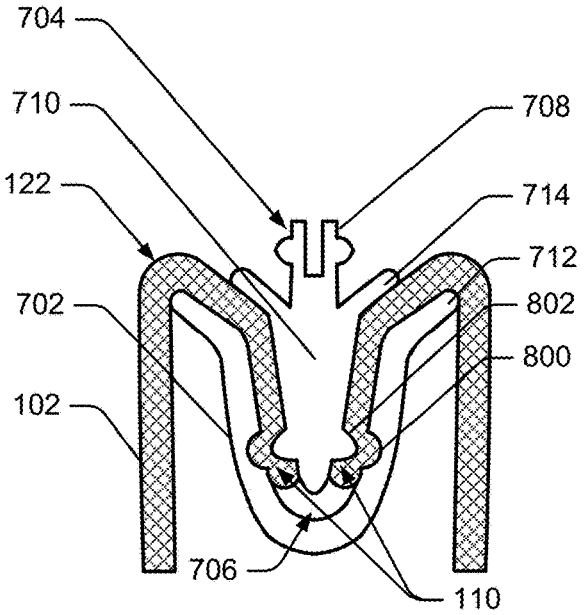

FIG. 8D shows insertion of the attachment component 704 into the receiving slot 706 of the base component 702. The attachment lug 708 engages the edges 110 of the strap 102, thereby securing the edges 110 of the strap 102 between the attachment lug 708 of the attachment component 704 and the receiving slot 706 of the base component 702. Thus, the coupling device 700 is attached to the strap 102 while projecting the attachment lug 708 of the attachment component 704 out of the opening 114 of the strap 102 beyond the end surfaces 122 of the strap 102. In implementations in which the base component 702 includes the base flange 712 and the attachment component 704 includes the attachment flange 714, the base flange 712 and the attachment flange 714 further secure the edges 110 of the strap 102 therebetween. In some implementations, the base component 702 includes recesses 800 within the receiving slot 706 configured to receive protrusions 802 extending from the attachment lug 708 of the component 704 to further secure the attachment lug 708 within the receiving slot 706 of the base component 702. In additional implementations, adhesive (not shown) may be applied within the receiving slot 706 to further secure the base component 702 with the attachment component 704 and further secure the edges 110 of the strap 102 therebetween.

Figure 9A:
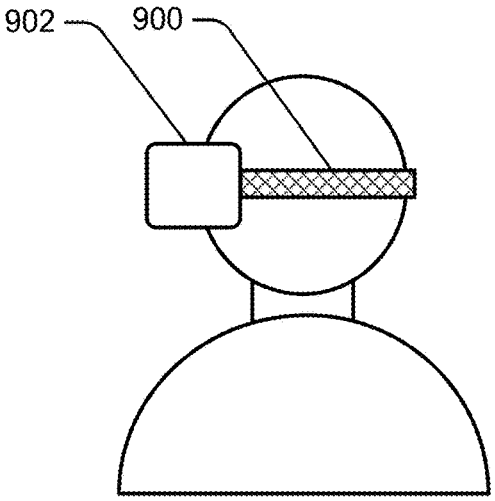
FIGS. 9A-9C illustrate schematic diagrams of implementations of an example band used to support different wearable devices.
Figure 9B:
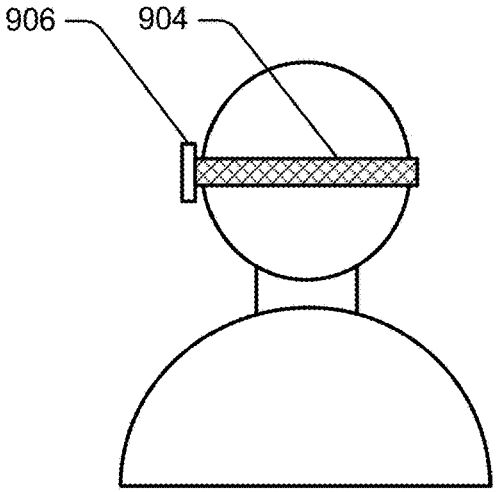
Figure 9C:
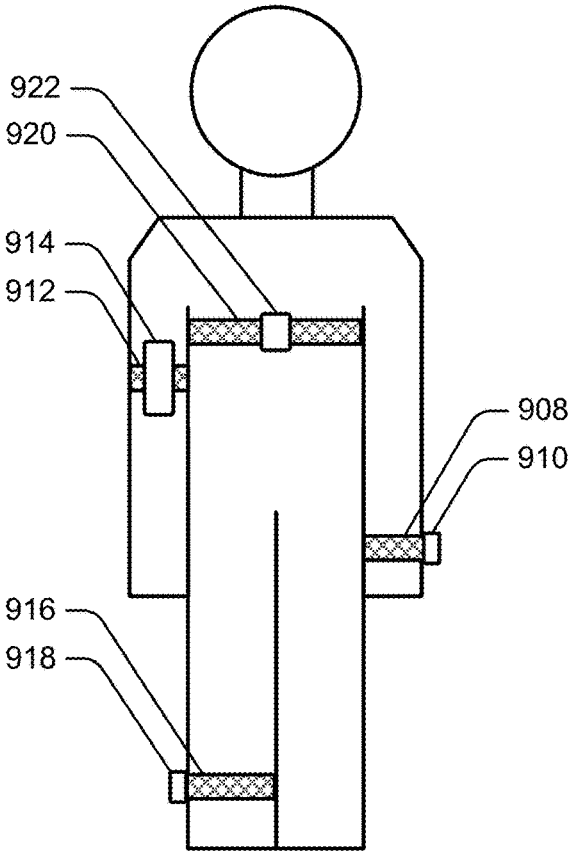

Implementations of the band 100 (FIG. 1) may be used with different wearable devices in addition to the smartwatch 400 (see FIGS. 4A and 4B). FIG. 9A shows a headband 900 coupled with virtual reality goggles 902. FIG. 9B shows a headband 904 coupled with augmented reality glasses 906. FIG. 9C shows other applications, including a wristband 908 coupled with a watch 910 that may be other than a smartwatch. An armband 912 is coupled with an arm-supported device 914, such as a smartphone holder. A leg band 916 is coupled with a leg-supported device 918 as may be used for fitness tracking, video game controls, or other applications. A chest band 920 may be coupled with a chest-supported device 922 that may include a fitness or health monitoring device or a media device. In each case, the bands 900, 904, 908, 912, 916, and 920 may include straps and coupling devices as previously described so that, when an attachment section is connected to the coupling (neither of which are shown in FIGS. 9A-9D) of one of the devices 902, 906, 910, 914, 918, and 922 end portions of the strap included in the bands 900, 904, 908, 912, 916, and 920 are positioned to engage surfaces of the devices 902, 906, 910, 914, 918, and 922 without a gap between the bands 900, 904, 908, 912, 916, and 920 and the devices 902, 906, 910, 914, 918, and 922, respectively.

Example Method

Figure 10:
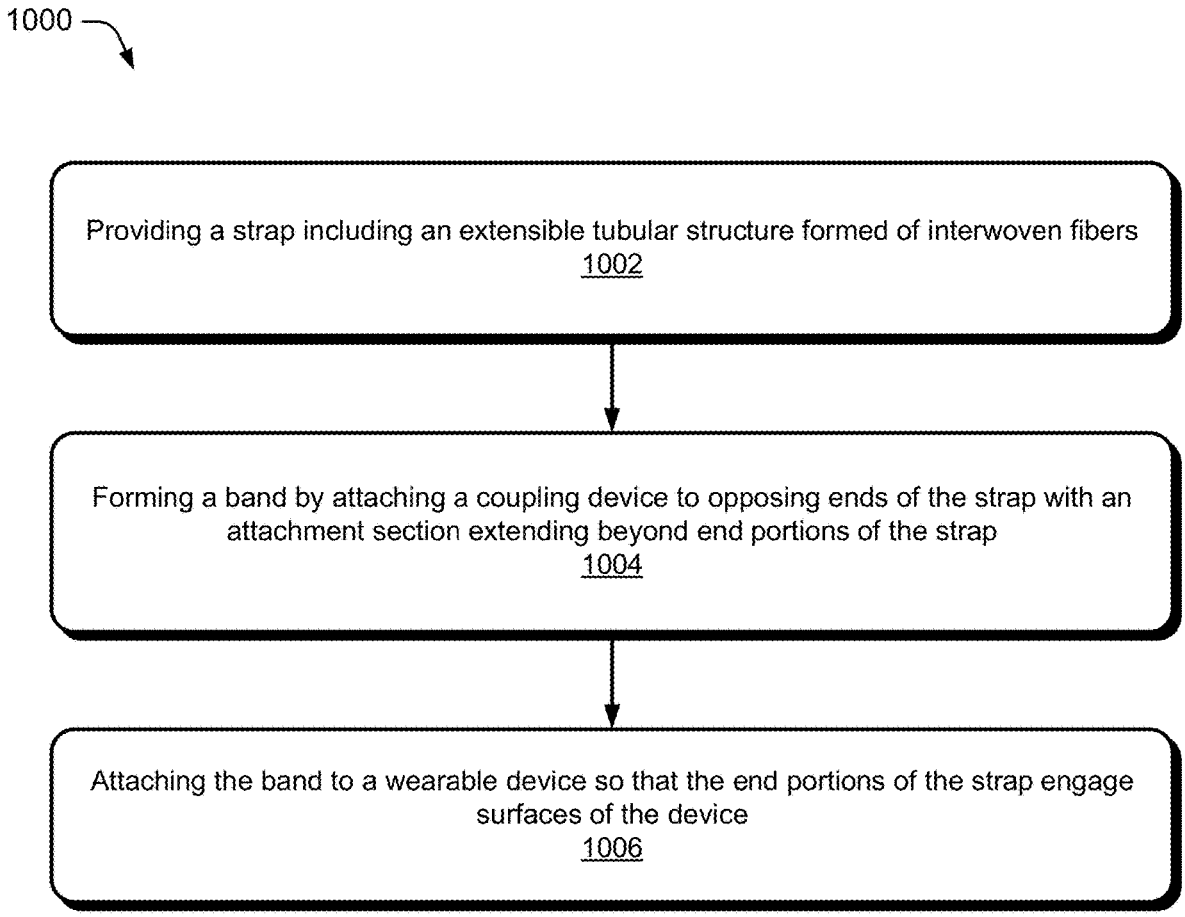
FIG. 10 illustrates a flow diagram of an example method of securing a wearable device with a band in which there is no gap between the band and the wearable device.

FIG. 10 illustrates an example method 1000 of securing a wearable device with a band in which there is no gap between the band and the wearable device, as previously described with reference to FIGS. 1-9C. At block 1002, a strap 102 including an extensible tubular structure formed of interwoven fibers 104 is provided. At a block 1004, a band is formed by attaching coupling devices, such as the one-piece coupling device 116 of FIGS. 1-4A or the multi-part coupling device 700 of FIGS. 7A-8D, to opposing ends of the strap 102, with an attachment section 120 extending beyond end portions 122 of the strap 102. At block 1006, the band is attached to the wearable device, including any of the devices 400, 902, 906, 910, 914, 918, and 922, so that the end portions 122 of the strap 102 engage surfaces 404 of the device.

Apparatuses and techniques as described herein may be realized using one or more of the entities or components shown in FIGS. 1-9D and used as described with reference to the example method of FIG. 10. Thus, these FIGS. 1-9D illustrate some of the many possible apparatuses capable of employing the described techniques.

CONCLUSION

Unless context dictates otherwise, use herein of the word "or" may be considered use of an "inclusive or," or a term that permits inclusion or application of one or more items that are linked by the word "or" (e.g., a phrase "A or B" may be interpreted as permitting just "A," as permitting just "B," or as permitting both "A" and "B"). Also, as used herein, a phrase referring to "at least one of" a list of items refers to any combination of those items, including single members. For instance, "at least one of a, b, or c" can cover a, b, c, a-b, a-c, b-c, and a-b-c, as well as any combination with multiples of the same element (e.g., a-a, a-a-a, a-a-b, a-a-c, a-b-b, a-c-c, b-b, b-b-b, b-b-c, c-c, and c-c-c, or any other ordering of a, b, and c). Further, items represented in the accompanying figures and terms discussed herein may be indicative of one or more items or terms, and thus reference may be made interchangeably to single or plural forms of the items and terms in this written description.

Although implementations of techniques and apparatuses directed at providing a tubular band with seamless lug integration for wearable devices have been described in language specific to certain features and/or methods, the subject of the appended claims is not necessarily limited to the specific features or methods described. Rather, the specific features and methods are disclosed as example implementations of techniques and apparatuses directed at providing a tubular band with seamless lug integration for wearable devices.

What is claimed is:

1. An apparatus to secure a wearable device to a portion associated with a user, the apparatus comprising:

a strap including an extensible tubular structure formed of interwoven fibers, the strap having opposing outward-facing edges at opposing longitudinal ends, each of the opposing outward-facing edges defining an opening; and coupling devices, each of the coupling devices including:

a base section fully receivable within the opening of a respective opposing outward-facing edge, the base section comprising a base component that defines a receiving slot configured to receive the opposing outward-facing edges of the strap; and an attachment section configured to extend from the base section outwardly through the opening to engage a coupling connector of the wearable device such that, when the attachment section is connected to the coupling connector, the attachment section positions an end portion of the strap adjacent to the opening to engage a surface of the wearable device.

2. The apparatus of claim 1, wherein the interwoven fibers are formed into the strap by at least one of knitting, braiding, weaving, or a combination thereof.

3. The apparatus of claim 1, wherein the strap includes lateral ribs, and wherein the lateral ribs are at least one of evenly-distributed ribs or variably-distributed ribs of equal size or of varying size.

4. The apparatus of claim 1, wherein one or more segments of the strap are dipped in or impregnated with a flexible material.

5. The apparatus of claim 1, wherein:

sides of the strap between the longitudinal ends are integrally joined sufficient to form the extensible tubular structure; or sides of the strap between the longitudinal ends are joined together via at least one of stitching or an adhesive.

6. The apparatus of claim 1, wherein the attachment section further comprises an attachment lug configured to engage the coupling connector of the wearable device.

7. The apparatus of claim 6, wherein:

the receiving slot of the base section is configured to receive a base lug; and the base lug is configured to (i) secure the opposing outward-facing edges of the strap within the receiving slot of the base component and (ii) position the end portion of the strap against a surface of the wearable device when the attachment lug engages the coupling connectors of the wearable device.

8. The apparatus of claim 1, wherein the wearable device comprises at least one of:

a smartwatch wearable on a wrist of the user;

a leg-supported device wearable on a leg of the user;

an arm-supported device wearable on an arm of the user;

a chest-supported device wearable around a chest of the user;

virtual reality goggles wearable on a head of the user; or augmented reality glasses wearable on the head of the user.

9. An apparatus to secure a wearable device to a portion associated with a user, the apparatus comprising:

a strap including an extensible tubular structure formed of interwoven fibers, the strap having opposing outward-facing edges at opposing longitudinal ends, each of the opposing outward-facing edges defining an opening, one or more segments of the strap are at least one of dipped in or impregnated with a flexible material; and coupling devices, each of the coupling devices including:

a base section fully receivable within the opening of a respective opposing outward-facing edge; and an attachment section configured to extend from the base section outwardly through the opening to engage a coupling connector of the wearable device such that, when the attachment section is connected to the coupling connector, the attachment section positions an end portion of the strap adjacent to the opening to engage a surface of the wearable device.

10. The apparatus of claim 9, wherein the flexible material is at least one of a flowable flexible material, a silicone material, or a polyurethane material.

11. The apparatus of claim 9, wherein at least one of the opposing longitudinal ends of the interwoven fibers comprise the flexible material.

12. The apparatus of claim 9, wherein the flexible material is applied to the longitudinal ends of the interwoven fibers.

13. An apparatus to secure a wearable device to a portion associated with a user, the apparatus comprising:

a strap including an extensible tubular structure formed of interwoven fibers, the strap having opposing outward-facing edges at opposing longitudinal ends, each of the opposing outward-facing edges defining an opening, sides of the strap between the longitudinal ends are joined to form the extensible tubular structure; and coupling devices, each of the coupling devices including:

a base section fully receivable within the opening of a respective opposing outward-facing edge; and an attachment section configured to extend from the base section outwardly through the opening to engage a coupling connector of the wearable device such that, when the attachment section is connected to the coupling connector, the attachment section positions an end portion of the strap adjacent to the opening to engage a surface of the wearable device.

14. The apparatus of claim 13, wherein at least a portion of the sides of the strap between the longitudinal ends are integrally joined to form the extensible tubular structure.

15. The apparatus of claim 13, wherein at least a portion of the sides of the strap between the longitudinal ends are knit together to integrally join the sides of the strap to form the extensible tubular structure.

16. The apparatus of claim 13, wherein at least a portion of the sides of the strap between the longitudinal ends are braided together to integrally join the sides of the strap to form the extensible tubular structure.

17. The apparatus of claim 13, wherein at least a portion of the sides of the strap between the longitudinal ends are integrally joined by weaving together the interwoven fibers to form the extensible tubular structure.

18. The apparatus of claim 13, wherein at least a portion of the sides of the strap between the longitudinal ends are joined together with stitching to integrally join the sides of the strap to form the extensible tubular structure.

19. The apparatus of claim 13, wherein at least a portion of the sides of the strap between the longitudinal ends are joined together with an adhesive to integrally join the sides of the strap to form the extensible tubular structure.

20. The apparatus of claim 13, wherein the base section further comprises a base component defining a receiving slot configured to receive the opposing outward-facing edges of the strap.

* * * * *